United States Patent [19]

Gross et al.

[11] 4,030,541

[45] June 21, 1977

[54] MULTI-ELEMENT TYPE RADIATOR OF PLASTIC MATERIAL

[75] Inventors: Erwin Gross, Burgsolms; Hans Vowinkel, Florsheim am Main, both of Germany

[73] Assignee: Hoechst Aktiengesellschaft, Frankfurt am Main, Germany

[22] Filed: June 6, 1975

[21] Appl. No.: 584,402

[30] Foreign Application Priority Data

June 8, 1974 Germany ..... 2422715

[52] U.S. Cl. ..... 165/175; 165/130; 165/DIG. 8

[51] Int. Cl.[2] ..... F28F 9/02

[58] Field of Search ..... 165/175, 130, 173, 178, 165/DIG. 8

[56] References Cited

UNITED STATES PATENTS

| | | | |
|---|---|---|---|
| 1,542,085 | 6/1925 | Persson | 165/130 |
| 1,671,347 | 5/1928 | Courot | 165/130 |
| 1,999,246 | 4/1935 | Maret | 165/130 X |
| 3,396,785 | 8/1968 | Kirsch | 165/175 |
| 3,750,744 | 8/1973 | Bouras | 165/175 X |

*Primary Examiner*—Carroll B. Dority, Jr.
*Assistant Examiner*—Ina S. Lazarus
*Attorney, Agent, or Firm*—Curtis, Morris & Safford

[57] ABSTRACT

A multi-element radiator of plastic material wherein the elements are closed of a plurality of vertical water pipes which discharge at their upper and lower ends into cylindrical tube sections and the end-faces of adjacent tube sections are connected to form the upper and lower horizontal collecting channels.

3 Claims, 2 Drawing Figures

MULTI-ELEMENT TYPE RADIATOR OF PLASTIC MATERIAL

Figure 1:
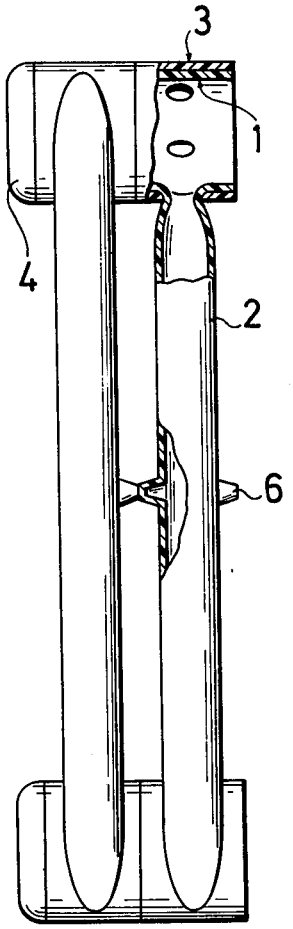

This invention relates to an improvement in a multi-element type radiator of plastic material.

Multi-element type radiators have vertical water channels and upper and lower collecting channels composed of shell-shaped headers. The ends of adjacent headers are connected with each other by threaded nipples or by welding. With multi-element radiators of steel or cast iron the vertical water channels may have any desired cross section since these materials have a sufficient rigidity to ensure that the channels are not deformed even with an unfavorable cross-sectional shape. In the case of radiators of plastic material the vertical water pipes should have a cross section such that in site of the relatively low rigidity of this material no deformation occurs. It has, therefore, been proposed to use water pipes with circular cross section as such a geometrical shape ensures the highest possible resistance to internal pressure (cf. German Pat. No. 2,140,486 and German Utility Model No. 6,601,479).

Another weak point of multi-element radiators lies in the region of the header. With the known shell-like shape of the headers a so-called accordion effect is observed if the rigidity of the material is too low, i.e. the multi-element radiator extends in the direction of the axis of the collecting channels. With radiators of steel this expansion is hindered by longitudinal tie rods which are secured by welding to the terminal elements.

An expansion in axial direction can also be prevented by connecting both ends of a header by welded-in rods or to provide the headers with axial recesses the bases of which are then welded together. But this means considerable expenditure of work and with radiator elements of plastic material such a manufacturing method is difficult to carry out. Moreover, the expansion is not hindered to a sufficient extent. The shell-like regions near the rods or recesses are still subject to heavy deformations.

It is an object of the present invention to provide the headers of radiator elements of plastic material with a shape such that an expansion in axial direction is hindered. Additional stiffening elements are unnecessary but may be used, if desired.

The multi-element radiator of plastic material according to the invention comprises vertical water pipes and an upper and lower collecting channel, wherein each radiator element is composed of a plurality of water pipes discharging at their upper and lower ends into cylindrical headers and the endfaces of adjacent cylindrical headpieces are connected to form the collecting channels.

In the radiator construction according to the invention the vertical water pipes do not end in shell-like headers but directly in cylindrical tube sections, preferably at a right angle with respect to the cylinder wall. To this effect the upper portions of the vertical water pipes are more or less curved, depending on their respective position. Such a construction is impossible with steel plate, whereas with a radiator of plastic material the entire element, i.e. the cylindrical tube section with the vertical water pipes can be produced in one working step, for example by extrusion blowing.

By connecting the end-faces of the cylindrical tube sections of adjacent elements, cylindrical collecting channels are formed the surface of which is parallel to the channel axis and, therefore, an accordion-like expansion is not possible. Because of the cylindrical shape of the tube section the collecting channels have an optimum resistance to internal pressure.

To reinforce the collecting channels the tube sections can be provided with additional strengthening rings.

In order to avoid weak points in the upper and lower portions of the water pipes where they enter the tube section it is advantageous to diminish the diameter of the pipes near the junction with the tube sections. By this reduction in the cross section, the radiator element is additionally stiffened in the region of the headers.

The individual water pipes may be stiffened by connecting them by means of continuous or intermittent webs.

In the extrusion blowing process there is generally produced first a radiator element the vertical water pipes of which are connected with each other by continuous webs. These webs are formed when the pipes are produced by compressing the extruded tube in the blow mold. If desired, the webs can be punched out in the blow mold or in a later process. For reasons of stability it is preferred to leave the webs at least partially.

Figure 2:
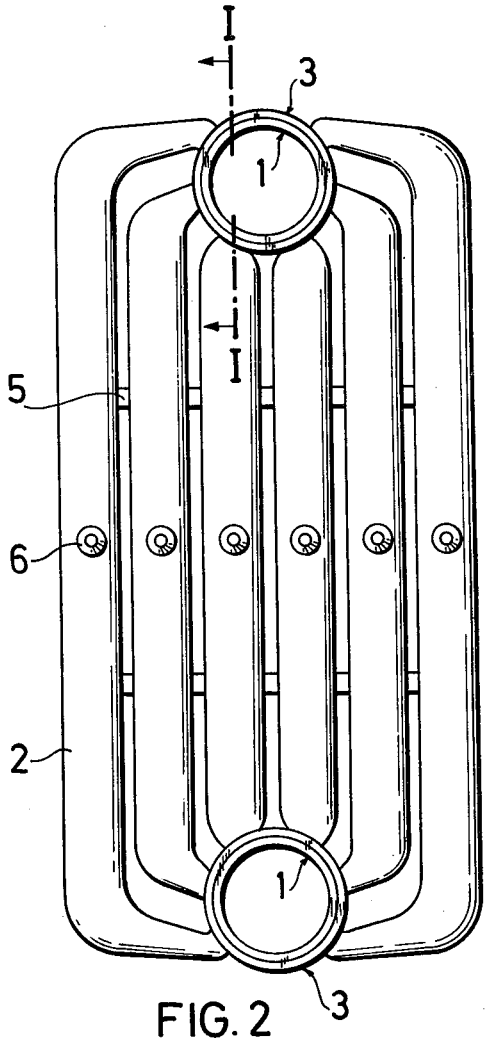

The multi-element radiator of plastic material according to the invention will now be described in further detail and by way of example with reference to the accompanying drawing of which FIG. 1 is a front elevation of two radiator elements partly broken away along line I — I of FIG. 2 and FIG. 2 is a side elevation of a radiator element.

Referring to the drawing, the radiator element consists of an upper and a lower tube section 1 and vertical water pipes 2 the end portions of which are curved, if necessary, to such an extent that they open at a right angle into the tube section. Reinforcing rings 3 around tube section 1 bring about an additional strengthening of the radiator. One terminal radiator element is closed by a cap 4 while the opposite terminal element is fitted with the necessary connections (not shown). The vertical water pipes are reinforced by continuous compressed seams, local stiffening webs 5 remaining behind after having punched out sections of the compressed seams, or by knobs 6 on the pipes. The radiator elements can be produced of plastic material by extrusion blowing. To improve the mechanical stability of the tube sections stiffening rings in the form of semi-shells can be inserted in the blow mold and welded with the tube sections. The individual radiator elements are welded together at the end-faces of the tube sections whereby cylindrical collecting channels are formed, which do not have surfaces in vertical position with respect to the axis and which exhibit a sufficient resistance to internal pressure in radial direction.

What is claimed is:

1. A multi-element radiator made of plastic material and comprising vertical water pipes connected to upper and lower collecting channels, each radiator element being composed of a plurality of said vertical pipes connected at their upper and lower ends to relatively thin-walled cylindrical tube sections of substantially uniform diameter and the end-faces of adjacent tube sections being connected to form horizontal tubular channels of substantially uniform diameter along the length thereof, the ends of said pipes being of diminished cross-section at their junctions with said tube sections and being aligned with a radius of said tube sections.

2. A multi-element radiator as claimed in claim 1, wherein the tube sections are reinforced by strengthening rings.

3. A multi-element radiator as claimed in claim 1, wherein the vertical water pipes of one radiator element and the vertical water pipes of adjacent radiator elements are strengthened by reinforcing members interconnecting said pipes.

* * * * *

UNITED STATES PATENT AND TRADEMARK OFFICE

CERTIFICATE OF CORRECTION

PATENT NO. : 4,030,541

DATED : June 21, 1977

INVENTOR(S) : Gross et al.

It is certified that error appears in the above-identified patent and that said Letters Patent are hereby corrected as shown below:

In the Heading, Item [30], change "2422715" to --2427715--.

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*